US005176020A

United States Patent [19]

Maruo et al.

[11] Patent Number: 5,176,020

[45] Date of Patent: Jan. 5, 1993

[54] METHOD FOR MANUFACTURING A CORRUGATED FIN AND A SHAPING ROLL APPARATUS THEREFOR

[75] Inventors: Sizuo Maruo; Akira Ichimura, both of Okazaki, Japan

[73] Assignee: Nippondenso Co., Ltd., Kariya, Japan

[21] Appl. No.: 786,789

[22] Filed: Nov. 1, 1991

[30] Foreign Application Priority Data

Nov. 2, 1990 [JP] Japan ..... 2-295450

[51] Int. Cl.[5] ..... B21D 53/04

[52] U.S. Cl. ..... 72/186

[58] Field of Search ..... 72/186

[56] References Cited

U.S. PATENT DOCUMENTS 3,850,018 11/1974 Drosnin .
4,067,219 1/1978 Bianchi .
4,315,356 2/1982 Laurie et al. ..... 72/186
4,464,920 8/1984 Stoehr et al. .

FOREIGN PATENT DOCUMENTS 63-44174 11/1988 Japan .
187218 7/1990 Japan ..... 72/186
2063331 6/1981 United Kingdom .
2080178 2/1982 United Kingdom .

*Primary Examiner*—Lowell A. Larson
*Attorney, Agent, or Firm*—Cushman, Darby & Cushman

[57] ABSTRACT

A plurality of toothed molds are formed on the respective outer peripheral surfaces of first and second rolls for shaping a fin material, each of the toothed molds having ridges extending parallel to the respective axes of the rolls. Each toothed mold includes a plurality of sets of shaping blades, each including a shaping recess, a flat portion adjoining the shaping recess, and a shaping projection adjoining the flat portion, extending at right angles to the extending direction of the ridges and arranged along the ridges. In this case, the fin material is shaped so that the shaping recesses of the first roll individually face the shaping projections of the second roll, and that the shaping projections of the first roll individually face the shaping recesses of the second roll, and louvers are formed by shearing. Draft grooves are formed in the respective opposite surfaces of the shaping projections on which the respective toothed molds of the first and second rolls engagedly adjoin one another.

6 Claims, 8 Drawing Sheets

METHOD FOR MANUFACTURING A CORRUGATED FIN AND A SHAPING ROLL APPARATUS THEREFOR

BACKGROUND OF THE INVENTION

1. Field of the Invention

The present invention relates to a manufacturing method and a shaping roll apparatus for a corrugated fin, which serves as a heat exchange mechanism incorporated in a heat exchanger of, e.g., a heating or cooling apparatus, and adapted to transfer heat of heating or cooling medium to air or some other medium to be heated or cooled.

2. Description of the Related Art

A corrugated fin is manufactured by feeding an elongated fin material at constant speed and shaping the fin material into a corrugated configuration by means of a pair of rollers.

FIG. 14 shows an arrangement of a shaping apparatus for manufacturing a corrugated fin of this type. An elongated fin material 11 is composed of a thin sheet of aluminum or copper material, for example. The fin material 11 is stored wound around an uncoiler 12. The material 11 on the uncoiler 12 is supplied between a pair of tension rollers 131 and 132, which serve to apply a fixed tension to a shaping section on the output side thereof.

The shaping section comprises a first shaping roll 14 on the upper side and a second shaping roll 15 on the lower side. The fin material 11 is fed between the paired rolls 14 and 15, and is drawn out as the rolls rotate. As the material 11 passes between the rolls 14 and 15, it is shaped into a corrugated fin by means of shaping molds formed on the respective outer peripheral surfaces of the rolls 14 and 15. The material 11, delivered from the shaping section formed of the rolls 14 and 15, is fed to a fin pitch reducing section 16, whereupon a shaped fin 17 is obtained.

The first and second shaping rolls 14 and 15 are provided with drive shafts 18 and 19, respectively, and are separately rotated by means of motors (not shown). The fin material 11 is bent into a continuous corrugated configuration, extending along the longitudinal direction thereof, by means of toothed shaping molds formed individually on the respective outer peripheral surfaces of the rolls 14 and 15.

SUMMARY OF THE INVENTION

An object of the present invention is to provide a method for manufacturing a corrugated fin, in which a fin member having a large number of louvers can be formed by shearing.

Another object of the invention is to provide a shaping roll apparatus for manufacturing a corrugated fin, in which sheared portions of a material can be smoothly released from shearing rolls without clinging to them, so that high-quality shearing work can be smoothly accomplished.

Still another object of the invention is to make fabrication of a corrugated fin smooth by allowing shearing blades to be disengaged from a fin material, especially at flat portions between louvers which alternately project on the opposite surfaces of the fin.

A shaping roll apparatus for manufacturing a corrugated fin according to the present invention comprises first and second rolls to which an elongated fin material is fed. Each of these rolls has a plurality of ridges on the outer peripheral surface thereof extending parallel to the roll axis. The fin material is fed between the first and second rolls so that a continuous corrugation is formed in the fin material along its feeding direction. The ridges of the first and second rolls are used to form a plurality of louvers which project from the corrugated side faces of the fin material and are arranged along the longitudinal direction thereof. A plurality of shaping recesses or projections for forming the louvers are formed on the side faces of the each ridge. Gaps corresponding to the end portions of the sheared material are formed in those side faces the recesses or projections which correspond to shearing corner portions thereof.

In the corrugated fin shaping roll apparatus constructed in this manner, the louvers projecting on either surface of the fin material can be formed with ease. If louver members, which are formed by shearing by means of the shaping recesses or projections, and flat members between the louver members are wider than shearing blades, moreover, the resulting marginal portions of the members are absorbed by the gaps, so that the fin material can be smoothly released from the rolls without clinging to the side faces of the roll blades. Thus, the corrugated fin can be smoothly fabricated, and the louver portions, in particular, of the fabricated fin can enjoy a normal configuration.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENT

Figure 1:
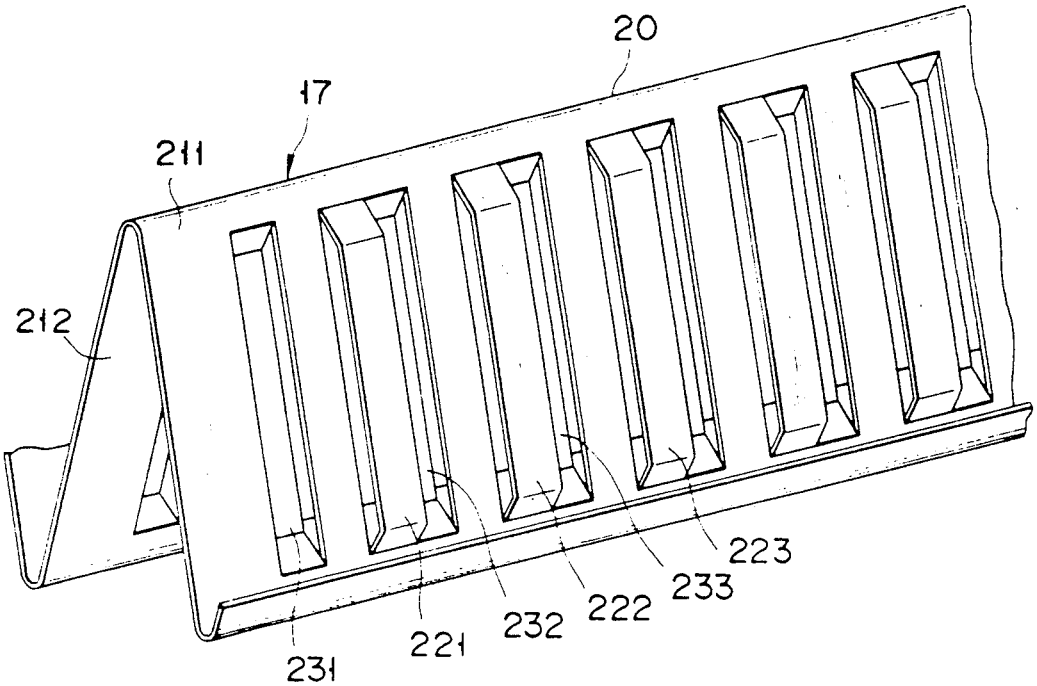
FIG. 1 is a partial view extractively showing part of a corrugated fin manufactured by a method according to the present invention.
Figure 14:
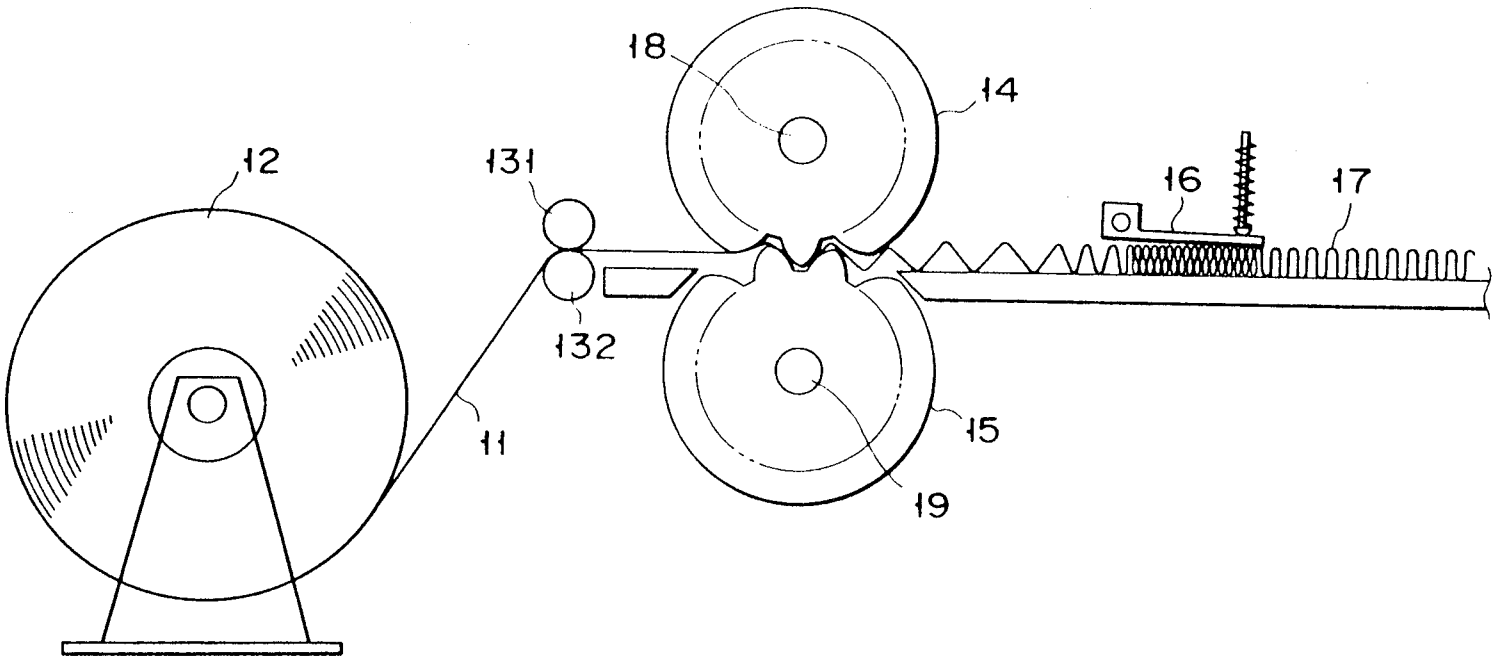
FIG. 14 is a diagram for illustrating a conventional fin manufacturing apparatus.

FIG. 1 extractively shows part of the fin 17 which is formed by means of the shaping rolls 14 and 15 of the apparatus shown in FIG. 14. The fin 17 has a large number of bend lines 20, which extend at right angles to the longitudinal direction of the fin material 11, and faces 211 and 212 are formed individually on the opposite sides of each line 20. Each of the faces 211 and 212 has a plurality of louvers 221, 222, . . . are formed by shear raising so as to project outward and arranged side by side in the extending direction of each bend line 20. Also, louvers 231, 232, . . . are formed by shear raising so as to project inward.

Figure 2:
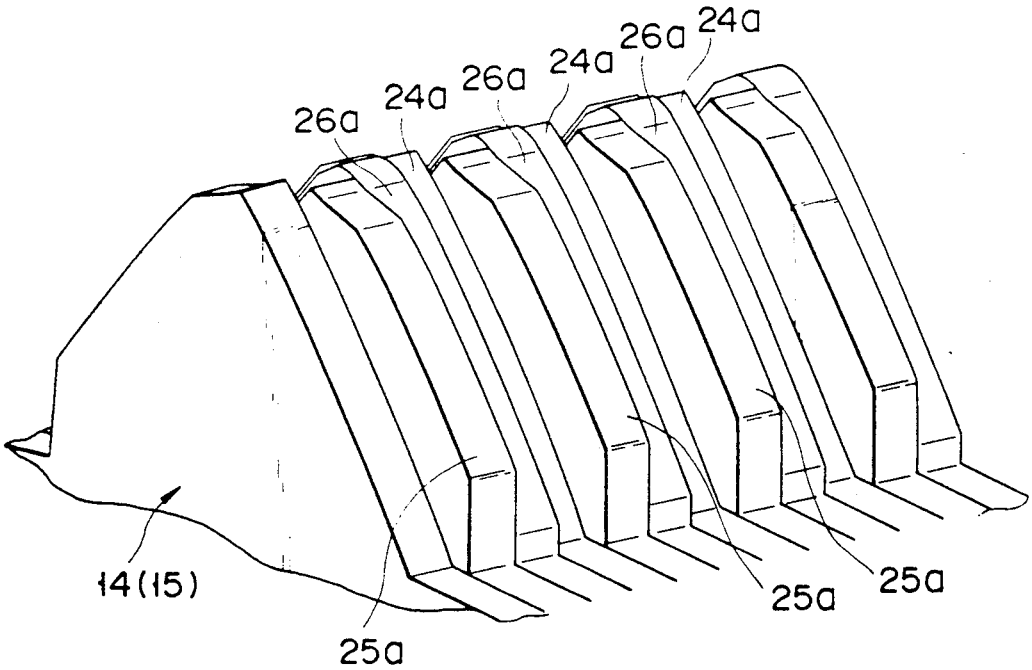
FIG. 2 extractively shows one of toothed molds of a shaping roll used for the manufacture of the corrugated fin.

FIG. 2 extractively shows one of the toothed shaping molds for forming the fin 17 which project from the outer peripheral surface of the first shaping roll 14. The second shaping roll 15 is constructed in like manner.

The shaping roll 14 is formed by stacking a large number of disk-shaped shaping tools, each having a toothed mold on the outer periphery thereof, in the axial direction, and then integrating them into a united body. In this case, the respective shapes of the molds on the individual shaping tools are different from one another, and a plurality of shaping recesses 24*a* and shaping projections 25*a* for shearing the louvers 221, 222, . . . and 231, 232, . . . are alternately formed by stacking the shaping tools. A flat portion 26*a* is formed between each shaping recess 24*a* and each shaping projection 25*a* adjacent thereto.

Thus, the fin 17, having the sheared louvers 221, 222, . . . and 231, 232, . . . , as shown in FIG. 1, is shaped as the first and second rolls 14 and 15, having the toothed molds thereon and in meshing engagement with each other, rotating with the fin material 11 between them.

Figure 3:
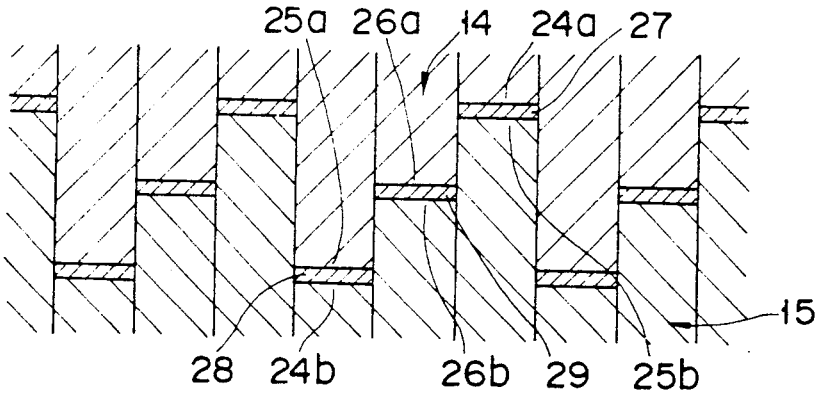
FIG. 3 is a sectional view showing a state in which the shaping rolls shown in FIG. 3 are in engagement with each other.

FIG. 3 shows an end face configuration of the first and second shaping rolls 14 and 15 engaged with the fin material between them. In FIG. 3, numerals 24*b*, 25*b* and 26*b* denote shaping recesses, shaping projections, and flat portions, respectively, of the second shaping roll 15.

When the fin material 11 is interposed between the first and second shaping rolls 14 and 15, the shaping recesses 24*a* of the first roll 14 engage their corresponding shaping projections 25*b* of the second roll 15, the shaping projections 25*a* of the roll 14 engage their corresponding shaping recesses 24*b* of the roll 15, and louver members 27 and 28 are formed by shearing between the recesses and the projections. In the position between each pair of louver members 27 and 28, a flat member 29 is formed between the respective flat portions 26*a* and 26*b* of the first and second rolls 14 and 15.

Figure 4A:
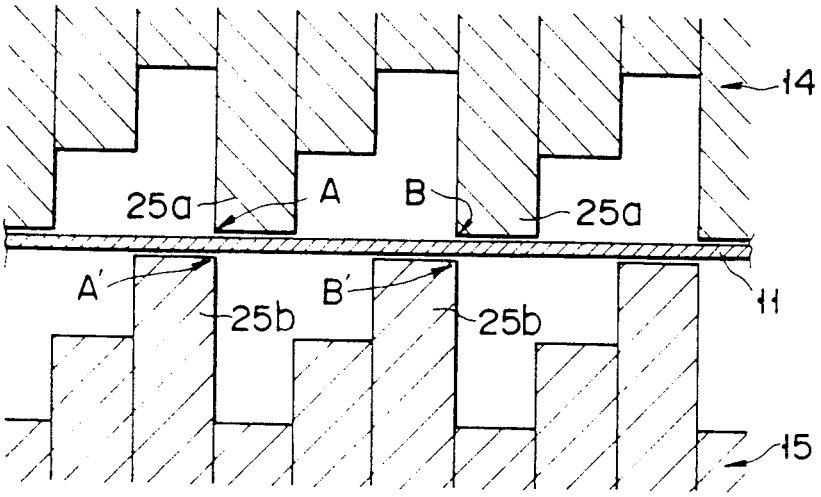
FIGS. 4A and 4B are sectional views for illustrating processes in which the shaping rolls engage with each other.
Figure 4B:
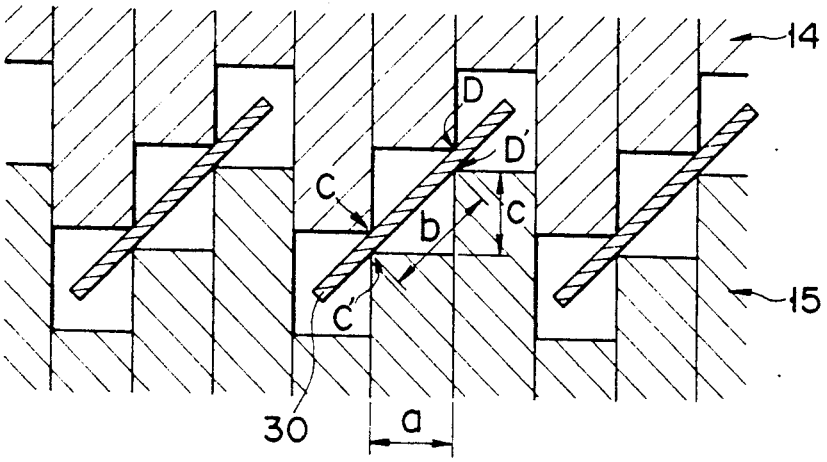

As shown in FIG. 4A, the fin material 11 interposed between the upper and lower shaping rolls 14 and 15 is sheared by means of shearing blades A and B of the shaping projections 25*a* of the roll 14 and shearing blades A′ and B′ of the shaping projections 25*b* of the roll 15. When the engagement between the upper and lower rolls 14 and 15 becomes deep, as shown in FIG. 4B, a material 30 obtained by shearing by means of the blades A and A′ and the blades B and B′ is inclined at an angle corresponding to $\tan^{-1}c/a$, and is further sheared by means of shearing blades C and C′ and blades D and D′. As a result, the central flat member 29 shown in FIG. 3 is formed by cutting. In this shear shaping, the difference between the width a of each shearing blade and the width b between each louver member 29 constitutes a main cause of deformation.

Figure 5A:
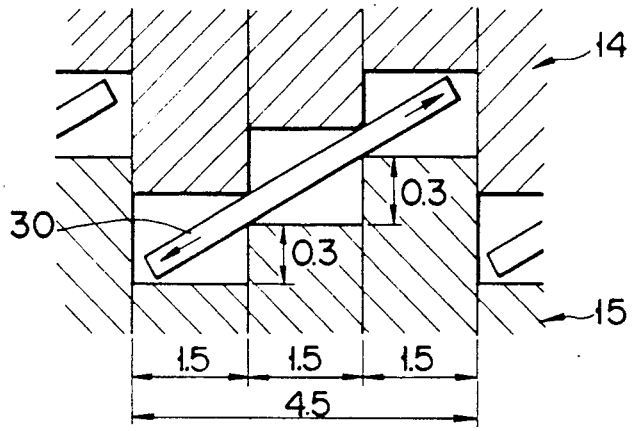
FIGS. 5A to 5C illustrate states of a fin material corresponding to the varied states of engagement of the shaping rolls.
Figure 5B:
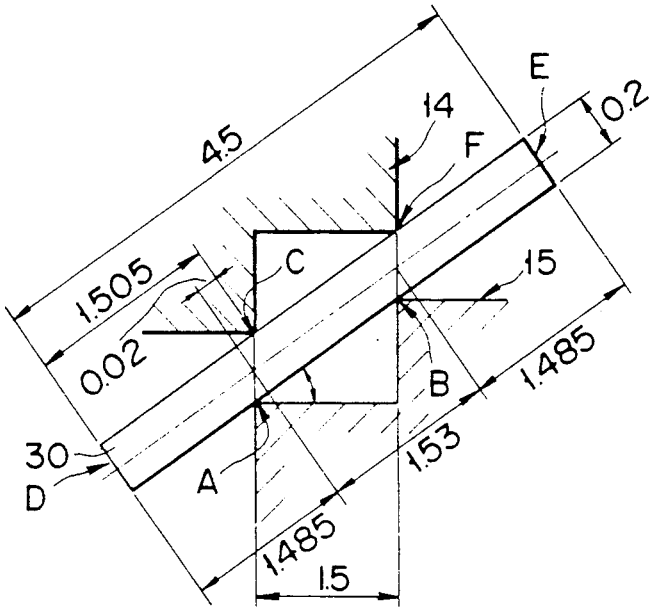

FIG. 5A illustrates specific dimensions with which the material 30 is sheared. The width of each shearing blade for shearing the material 30 is 1.5 mm, and the difference in height level between each shearing recess and each central flat portion adjacent thereto is 0.3 mm. FIG. 5B is an enlarged view showing the state of the louver material 30 and dimensional relationships obtained with use of these dimensions. The thickness of the material 30 is 0.2 mm. The points on which the shearing blades abut against material 30 are indicated by A, B and C, individually, and the positions of the opposite ends of the material 30 are indicated by D and E, individually. As compared with the width a (=1.5 mm) of each shearing blade, the width (indicated by D-C or B-E in FIG. 5B) of that portion of the material 30 which corresponds to each louver member 27 or 28 measures 1.505 mm. Thus, the width of the sheared flat louver member 30 is 0.005 mm longer than that of the sheared portion for the louvers 27 and 28, and the marginal portion clings to the roll blades and cannot be easily released from the rolls. If the material is compressed in this state, the portion for each flat member 29 is distorted into a wavy shape between the flat portions 26*a* and 26*b*, so that the fin shape is spoiled.

Figure 5C:
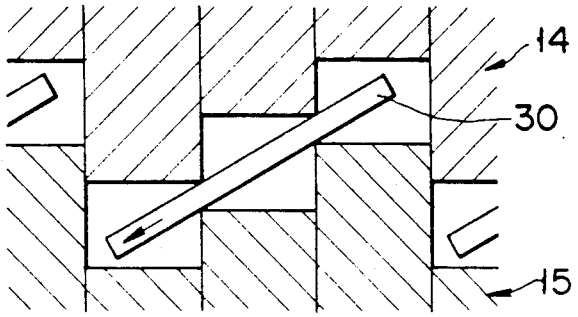

In some cases, moreover, the sheared material 30 may be biased in the direction indicated by the arrow in FIG. 5C or in the opposite direction. In this state, the projecting-side end portion of the material 30 touches the side face of a shearing blade, so that the material cannot be easily released from the rolls.

As seen from FIG. 5B, moreover, the sheared faces of the fin material are not vertical with respect to the surfaces thereof, and are somewhat inclined. Naturally, therefore, the sheared material has a width greater than the width a of each shearing blade, and the sheared portions suffer cutting burrs. In some cases, moreover, the thickness of the material is extended to thereby lengthen the louver width, so that the roll release characteristic is lowered.

Figure 6:
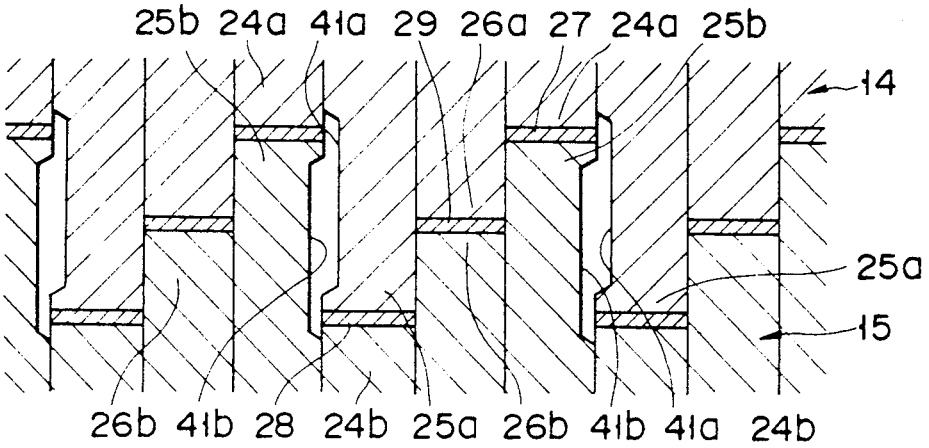
FIG. 6 is a sectional view showing a state in which shaping rolls used in a corrugated fin manufacturing apparatus according to a second embodiment of the present invention are in engagement with each other.
Figure 7:
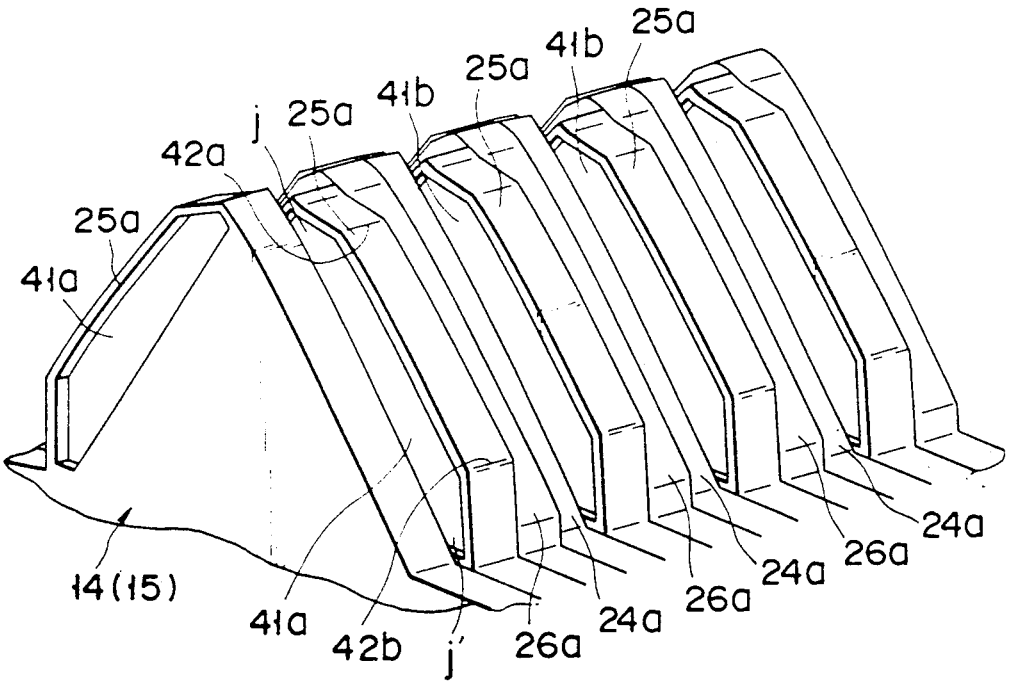
FIG. 7 is a schematic view extractively showing one of toothed molds of the shaping roll.

FIG. 6 shows first and second rolls 14 and 15 in engagement with each other, according to a second embodiment of the present invention, which solves the problems of the first embodiment. FIG. 7 extractively shows one of toothed shaping molds of the roll 14 (or 15).

The first roll 14 is formed with a plurality of shaping recesses 24*a* and shaping projections 25*a*, and flat portions 26*a* are formed between them. The second roll 15 is formed with shaping projections 25*b* which face the shaping recesses 24*a*, individually, shaping recesses 24*b* which face the shaping projections 25*a*, individually, and flat portions 26*b* which face the flat portions 26*a*, individually.

Draft grooves 41*a* and 41*b* are formed individually in the respective side faces of shaping blades which constitute the shaping projections 25*a* and 25*b*, individually. Each groove 41*a* and its corresponding groove 41*b* face each other so that a gap is defined between each two adjacent shaping blades. Each of the draft grooves 41*a* and 41*b* extends fully between end portions j and j' of each shaping blade, in the longitudinal direction of the side face of the blade on which the shaping projection 25*a* or 25*b* is formed (see FIG. 7).

With use of the upper and lower rolls 14 and 15 constructed in this manner, the end portions of sheared louver members 27 and 28 enter the gaps defined by the draft grooves 41*a* and 41*b* to facilitate roll release even through they cling to the side faces of the shaping projections 25*a* or 25*b*.

Figure 8:
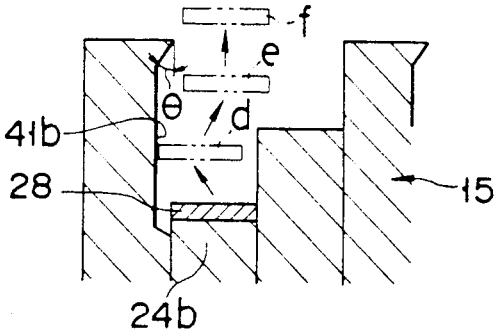
FIG. 8 is a schematic view for illustrating the behavior of a sheared member to be released from the roll.

When the upper roll 14 is disengaged from the lower roll 15, the louver member 28 which is fitted in one of the shaping recesses 24*b* of the roll 15, for example, can freely behave in the manner indicated by d-e-f, as shown in FIG. 8, without being confined in the recess 24*b*. Thus, the louver member 25 can be easily disengaged from the recess 24*b*, that is, the roll release is smooth. The roll release characteristic can be further improved by forming a gradient $\theta$ as illustrated at each corner portion of the draft grooves 41*a* and 41*b*.

If the fin material 11 to be worked into a corrugated fin is thinner, or if it is shaped at high speed, a satisfactory roll release characteristic sometimes cannot be obtained with the aid of the draft grooves 41*a* and 41*b* only. In particular, the roll release is liable to be reluctant at the shaping recesses 24*a* and 24*b* corresponding to edges 42*a* and 42*b* (see FIG. 7) of the shaping projections 25*a* and 25*b*, respectively, which correspond individually to the opposite end corner portions of each louver member.

Figure 9:
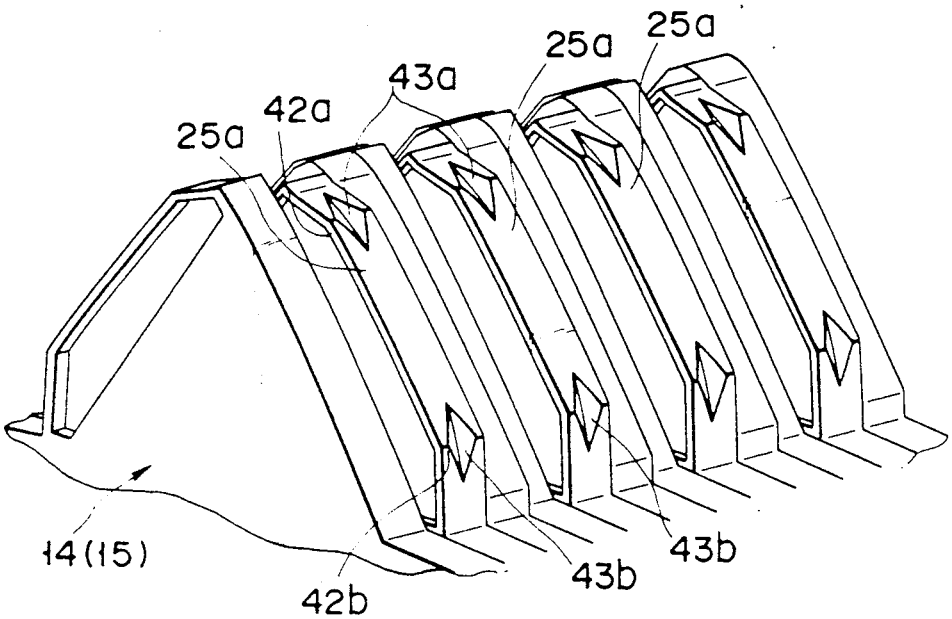
FIG. 9 is a schematic view extractively showing one of toothed molds of a shaping roll of a manufacturing apparatus according to a third embodiment of the present invention.

FIG. 9 shows a third embodiment of the present invention, in which the above problem is solved by forming grooves 43*a* and 43*b* with a U- or V-shaped cross section corresponding to the edges 42*a* and 42*b*, respectively.

Figure 10:
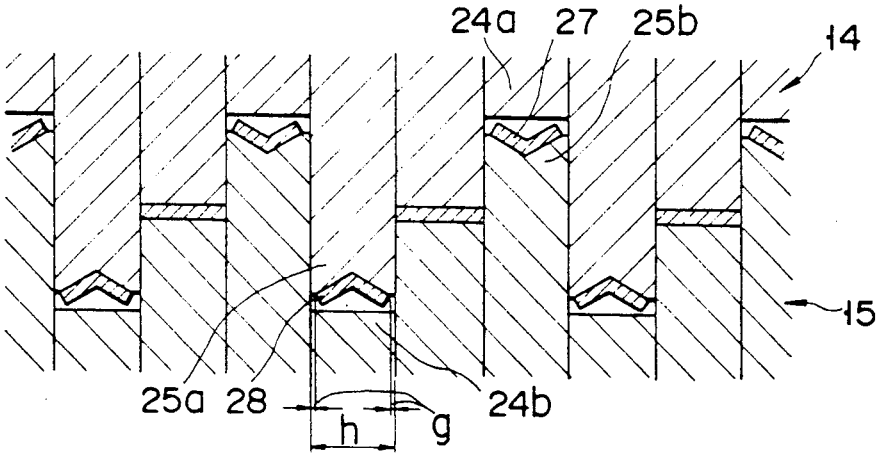
FIG. 10 is a sectional view showing a state in which the shaping rolls according to the third embodiment are in engagement with each other.

FIG. 10 is an enlarged view showing the grooves 43*a* (or 43*b*) and those portions of louver members 27 and 28 which are formed by means of the groove portions. The louver members 27 and 28, which are sheared to a width h by means of shaping projections 25*a* and 25*b* and shaping recesses 24*a* and 24*b*, are bent into a U- or V-shaped cross section by means of the grooves 43*a* (43*b*). Thus, a gap g is formed between each louver member and its corresponding shaping recess 24*a* and 24*b*, so that the mold release is smooth at the recesses.

Figure 11:
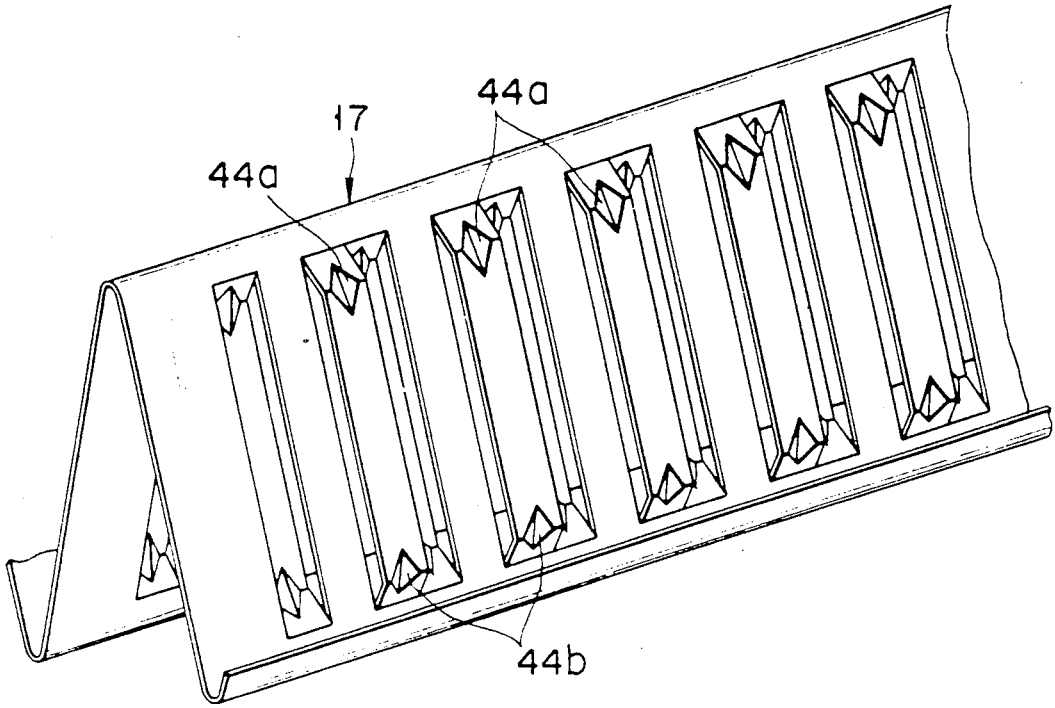
FIG. 11 is a schematic view extractively showing part of a corrugated fin formed according to the third embodiment.

FIG. 11 shows a fin 17 shaped by means of shaping rolls 14 and 15 according to the third embodiment arranged in this manner. In this case, grooves 44*a* and 44*b* are formed at the upper and lower corner portions of each louver, respectively.

In the embodiments described above, the roll release characteristic of the louver members 27 and 28, formed between the shaping recesses and the shaping projections, is effectively restrained from lowering. In this case, however, no consideration is given to deformation of the flat member 29 formed by shearing between the respective flat portions 26*a* and 26*b* of the rolls 14 and 15.

Figure 12:
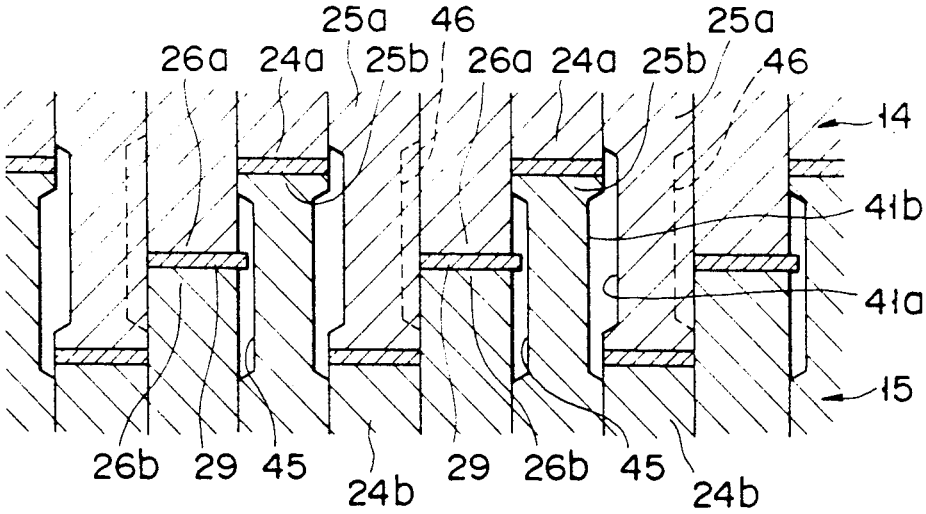
FIG. 12 is a sectional view showing a state in which shaping rolls of an apparatus according to a fourth embodiment of the present invention are in engagement with each other.

FIG. 12 shows a fourth embodiment for restraining the deformation of the central flat member 29. A relief groove 45 is formed, for example, in that side face of each shaping projection 25*b* of a lower or second roll 15 which adjoins a flat portion 26*b* corresponding thereto. In this case, the depth of the groove 45 is not shorter than "b - a" or the difference between the widths a and b shown in FIG. 4B.

By forming the relief groove 45 in this manner, a margin for the escape of the sheared louver is provided corresponding to the difference between the width a of the shearing blade and the width b of the louver, whereby the central flat member 29 can be securely prevented from being deformed. In this case, the relief groove 45 of the louver, like the draft grooves 41*a* and 41*b*, extends covering the full length of the side face of each projection 25*b*.

Although the relief groove 45 is formed in the side face of each shaping projection 25*b* in the arrangement described above, it is to be understood that a relief groove 46 may be formed in the side face of each shaping projection 25*a* of the roll 14, as indicated by broken line in FIG. 12. Also, the relief grooves 45 and 46 may be formed on each of the first and second rolls 14 and 15.

According to the corrugated fin manufacturing apparatus using the shaping rolls constructed in this manner, an elongated fin material can be shaped into a continuous corrugated configuration, and a large number of louvers can be simultaneously formed by shearing. In shearing the louvers, in particular, the fin material can be smoothly released from the rolls, so that it can be shaped with accuracy. Moreover, high-speed fabrication can be achieved easily and securely.

Figure 13:
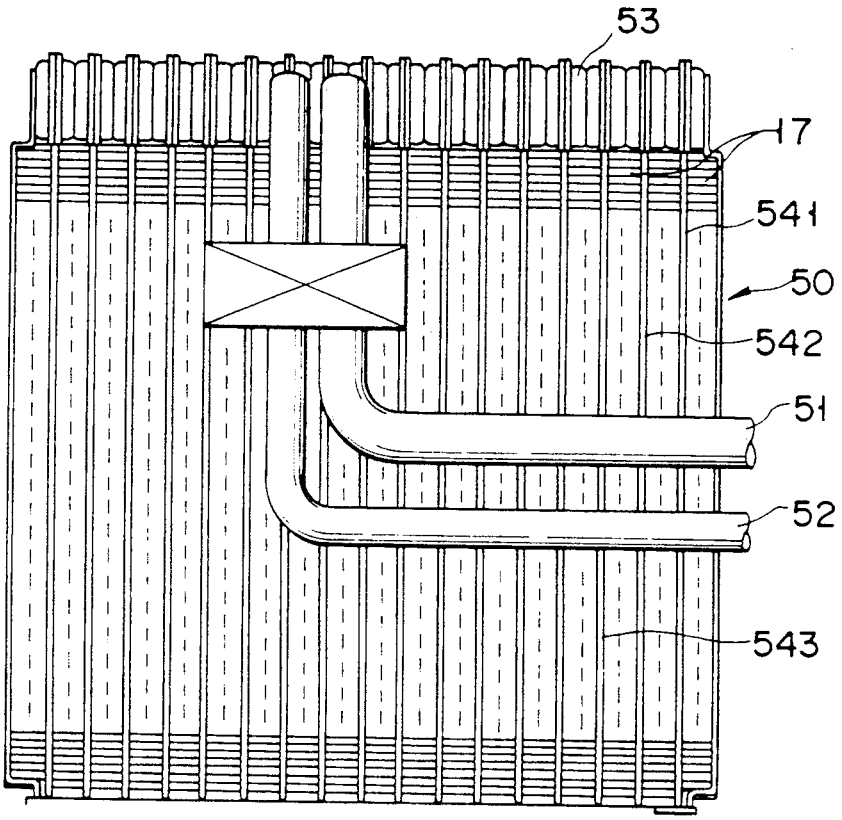
FIG. 13 shows a refrigerant evaporator of a car air-conditioner which uses the corrugated fin manufactured in the aforesaid manner.

FIG. 13 shows a specific example of application of the corrugated fin 17 manufactured according to the embodiments described above. For example, the fin 17 is used as heat exchangers means for a refrigerant evaporator 50 of a car air-conditioner. The evaporator 50 comprises an inlet pipe 51, through which a refrigerant compressed by means of a refrigerant compressor (not shown) is supplied, and an outlet pipe 52 through which the refrigerant is delivered after undergoing heat exchange. The refrigerant supplied from the inlet pipe 51 is delivered to a tank 53. The tank 53 is provided with a refrigerant circulating circuit which is formed of a large number of thin-walled tubes 541, 542, . . . The refrigerant circulated in the tubes 541, 542, . . . is guided into the outlet pipe 52.

The tubes 541, 542, . . . , which constitute the refrigerant circulating circuit, are arranged at regular intervals, and the corrugated fin 17 is interposed between the tubes, whereby heat exchange between air and the refrigerant flowing in the tubes is achieved with high efficiency.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A shaping roll apparatus for a corrugated fin comprising:

first and second shaping rolls arranged for feeding elongated fin material; and toothed molds formed on respective outer peripheral surfaces of each of the first and second rolls, said toothed molds including a plurality of ridges for bending the fin material along lines intersecting a longitudinal direction of said fin material in alternate opposite directions, rotation of said first and second rolls permitting said tooth molds to smoothly mesh with each other to facilitate bending of the fin material, each said tooth mold including:

a plurality of shaping blades formed at intervals on side faces of said tooth mold, each shaping blade having shearing corner portions for shearing the fin material, and draft grooves formed in said side face of each said shaping blade at a location corresponding to said shearing corner portion so that an end portion of the fin material sheared by said shaping blade enters said grooves.

2. An apparatus, according to claim 1, wherein said shaping blades are configured as a plurality of shaping blade sets arranged along a longitudinal direction of the ridge, each said set including a shaping recess, a flat portion adjoining the shaping recess and a shaping projection adjoining the flat portion, louvers being formed in said fin material by shearing in a manner such that the shaping projections of the second roll individually face said shaping recesses of the first roll, and said shaping projections of the first roll individually face said shaping recesses of the second roll, and said draft grooves are formed respectively in side faces of the first and second rolls where the shaping projections of the rolls face each other.

3. An apparatus according to claim 2, wherein each of said draft grooves is formed between end portions of the side face of the shaping projections and extend to cover all portions of said side face except a shearing blade of the shaping projections.

4. An apparatus according to claim 1, wherein said shaping blades include a plurality of shaping projections disposed at intervals along a longitudinal direction of said ridges, and said draft grooves are formed at opposite end corner portions of each said shaping projection.

5. An apparatus according to claim 1, wherein said shaping blades are configured as a plurality of shaping blade sets arranged along a longitudinal direction of each said ridge, each said set including a shaping recess, a flat portion adjoining the shaping recess, and a shaping projection adjoining the flat portion, louvers are formed in the fin material by shearing in a manner such that the shaping projections of the second row individually face the shaping recesses of the first roll, and the shaping projections of the first row individually face the shaping recesses of the second roll, said draft grooves are formed in respective side faces of the first and second rolls where the shaping projections of the rolls face each other, and a relief groove is formed in said side face of each shaping projection of the first or second shaping rolls which adjoins the flat portion.

6. An apparatus according to claim 1, wherein said shaping blades are configured as a plurality of shaping blade sets arranged along a longitudinal direction of each said ridge, each said set including a shaping recess, a flat portion adjoining the shaping recess and a shaping projection adjoining the flat portion, louvers are formed in the fin material by shearing in a manner such that the shaping projections of the second roll individually face the shaping recesses of the first roll, and the shaping projections of the first roll individually face the shaping recesses of the second roll, said draft grooves are formed in the respective side faces of the first and second rolls where the shaping projections of the rolls face each other, and relief grooves are individually formed in side faces of respective shaping projections of the first and second shaping rolls which adjoin the flat portion.

* * * * *